US007947087B2

(12) United States Patent
Penninger et al.

(10) Patent No.: US 7,947,087 B2
(45) Date of Patent: May 24, 2011

(54) COLOR TRANSFER INHIBITORS, DETERGENT COMPOSITIONS CONTAINING THE SAME AND USES THEREFOR

(75) Inventors: Josef Penninger, Hilden (DE); Birgit Glüsen, Düsseldorf (DE)

(73) Assignee: Henkel AG & Co. KGaA (DE)

( * ) Notice: Subject to any disclaimer, the term of this patent is extended or adjusted under 35 U.S.C. 154(b) by 310 days.

(21) Appl. No.: 12/282,610

(22) PCT Filed: Feb. 8, 2007

(86) PCT No.: PCT/EP2007/001054

§ 371 (c)(1), (2), (4) Date: Sep. 11, 2008

(87) PCT Pub. No.: WO2007/104392

PCT Pub. Date: Sep. 20, 2007

(65) Prior Publication Data

US 2009/0069210 A1 Mar. 12, 2009

(30) Foreign Application Priority Data

Mar. 14, 2006 (DE) ..... 10 2006 012 018

(51) Int. Cl.
*B08B 3/04* (2006.01)
*C11D 3/28* (2006.01)
*C11D 3/37* (2006.01)

(52) U.S. Cl. ..... 8/137; 510/276; 510/327; 510/330; 510/500; 510/505; 8/115.51; 8/183; 8/190

(58) Field of Classification Search ..... 510/276, 510/327, 330, 500, 505; 8/137, 115.51, 183, 8/190

See application file for complete search history.

(56) References Cited

U.S. PATENT DOCUMENTS

| | | | | |
|---|---|---|---|---|
| 3,234,258 | A | 2/1966 | Morris | |
| 3,290,305 | A | 12/1966 | Schmitz | |
| 3,817,702 | A * | 6/1974 | Paulus et al. | 8/120 |
| 4,585,642 | A | 4/1986 | Rieck et al. | |
| 4,755,319 | A | 7/1988 | Smolka et al. | |
| 4,820,439 | A | 4/1989 | Rieck et al. | |
| 4,898,621 | A | 2/1990 | Pruehs et al. | |
| 4,985,553 | A | 1/1991 | Fuertes et al. | |
| 5,075,041 | A | 12/1991 | Lutz | |
| 5,183,651 | A | 2/1993 | Schimmel et al. | |
| 5,236,682 | A | 8/1993 | Schimmel et al. | |
| 5,268,156 | A | 12/1993 | Schimmel et al. | |
| 5,308,596 | A | 5/1994 | Kotzian et al. | |
| 5,356,607 | A | 10/1994 | Just et al. | |
| 5,494,488 | A | 2/1996 | Arnoldi et al. | |
| 5,541,316 | A | 7/1996 | Engelskirchen et al. | |
| 5,542,951 | A | 8/1996 | Antwerpen et al. | |
| 5,607,618 | A | 3/1997 | Antwerpen et al. | |
| 5,677,384 | A | 10/1997 | Detering et al. | |
| 5,830,956 | A | 11/1998 | Stockhausen et al. | |
| 5,846,924 | A | 12/1998 | Detering et al. | |
| 5,854,321 | A | 12/1998 | Krause et al. | |
| 5,880,252 | A | 3/1999 | Kim et al. | |
| 5,922,670 | A | 7/1999 | Knuebel et al. | |
| 7,011,772 | B2 | 3/2006 | Heidenfelder et al. | |
| 2005/0282726 | A1 | 12/2005 | Carswell et al. | |

FOREIGN PATENT DOCUMENTS

| | | | |
|---|---|---|---|
| CA | 2053900 | A1 | 10/1990 |
| CA | 2037897 | B1 | 2/1991 |
| CA | 2156502 | | 11/1994 |
| DE | 1962899 | | 6/1971 |
| DE | 2412837 | | 10/1974 |
| DE | 2814287 | A1 | 10/1979 |
| DE | 2814329 | A1 | 10/1979 |
| DE | 3803630 | A1 | 8/1989 |
| DE | 0164552 | B1 | 7/1990 |
| DE | 4221381 | C1 | 2/1994 |
| DE | 4321022 | A1 | 1/1995 |
| DE | 4328254 | A1 | 3/1995 |
| DE | 4417734 | A1 | 11/1995 |
| DE | 4303320 | C2 | 12/1995 |
| DE | 19503061 | A1 | 8/1996 |
| DE | 19513391 | A1 | 10/1996 |
| DE | 4300772 | C2 | 3/1997 |
| EP | 0232202 | B1 | 8/1987 |
| EP | 0135217 | B1 | 2/1988 |
| EP | 0262897 | A2 | 4/1988 |

(Continued)

OTHER PUBLICATIONS

"Everyday Products with High-Tech Dimensions", Hoechst High Chem Magazine, 1993, vol. 14, pp. 33-38.

(Continued)

*Primary Examiner* — Brian P Mruk

(74) *Attorney, Agent, or Firm* — Connolly Bove Lodge & Hutz LLP

(57) ABSTRACT

Detergent compositions comprising a color transfer inhibitor and optionally surfactant(s), the color transfer inhibitor comprising one or more compounds selected from the group consisting of triazine derivatives corresponding to general formulae I and II:

$$T(NH—Ar(CO_2M)_a)_bHal_c \quad (I)$$

$$X—NH—CH_2CH_2—(NY—CH_2CH_2—)_nNH—X \quad (II)$$

wherein T represents a 1,3,5-triazinyl group; Ar represents a phenyl group; each M independently represents a substituent selected from the group consisting of H, Na, Li, and K; each Hal independently represents a halogen selected from the group consisting of Cl, Br, and I; each a independently represents 1, 2 or 3; b and c each represent 1 or 2 wherein b+c=3; each X represents a $T(NH—Ar(CO_2M)_a)_bHal_{c-1}$ group; each Y independently represents H or X; and n represents a number of 0 to 50, and uses therefor in washing and treating dyed and/or undyed textiles.

14 Claims, No Drawings

FOREIGN PATENT DOCUMENTS

| | | | | |
|---|---|---|---|---|
| EP | 0294753 | B1 | | 12/1988 |
| EP | 0164514 | B1 | | 6/1989 |
| EP | 0452428 | B1 | | 10/1991 |
| EP | 0300305 | B1 | | 2/1993 |
| EP | 0425427 | B1 | | 12/1993 |
| EP | 0502325 | B1 | | 8/1994 |
| EP | 0436835 | B1 | | 4/1995 |
| EP | 0548599 | B1 | | 6/1995 |
| EP | 0625992 | B1 | | 5/1997 |
| EP | 0584738 | B1 | | 4/1998 |
| EP | 0584709 | B | | 10/1998 |
| EP | 0610846 | B1 | | 1/1999 |
| EP | 950751 | | * | 10/1999 |
| EP | 0950751 | A1 | | 10/1999 |
| EP | 0979861 | A1 | | 2/2000 |
| JP | 58/217598 | | | 12/1983 |
| JP | 04238809 | | | 8/1992 |
| JP | 04260610 | | | 9/1992 |
| JP | 2002138368 | | | 5/2002 |
| WO | WO-90/13533 | A1 | | 11/1990 |
| WO | WO-91/05839 | A1 | | 5/1991 |
| WO | WO-91/08171 | A1 | | 6/1991 |
| WO | WO-92/18542 | A1 | | 10/1992 |
| WO | WO-92/18687 | A1 | | 10/1992 |
| WO | WO-94/02579 | A1 | | 2/1994 |
| WO | WO-94/10281 | A1 | | 5/1994 |
| WO | WO-94/26796 | A1 | | 11/1994 |
| WO | WO-94/29422 | A1 | | 12/1994 |
| WO | WO-95/03382 | A1 | | 2/1995 |
| WO | WO-95/03388 | A1 | | 2/1995 |
| WO | WO-95/06098 | A1 | | 3/1995 |
| WO | WO-95/07331 | A1 | | 3/1995 |
| WO | WO-95/09194 | A1 | | 4/1995 |
| WO | WO-95/19953 | A1 | | 7/1995 |
| WO | WO-95/19954 | A1 | | 7/1995 |
| WO | WO-96/10079 | A1 | | 4/1996 |
| WO | WO-96/12845 | A1 | | 5/1996 |
| WO | WO-96/12846 | A1 | | 5/1996 |
| WO | WO-01/72935 | A2 | | 10/2001 |

OTHER PUBLICATIONS

Dany, F.-J., et al., "Kristallines Schichtsilikat—ein neuer Builder", Seifen—Öle—Fette—Wachse, 1990, vol. 116, No. 20, pp. 805-808.

* cited by examiner

COLOR TRANSFER INHIBITORS, DETERGENT COMPOSITIONS CONTAINING THE SAME AND USES THEREFOR

CROSS-REFERENCE TO RELATED APPLICATIONS

This application is a national stage application, under 35 U.S.C. §371, of PCT/EP2007/001054, filed Feb. 8, 2007, which claims benefit of German Application No. 10 2006 012 018.3, filed Mar. 14, 2006.

BACKGROUND OF THE INVENTION

The present invention relates to the use of carboxylated triazine derivatives as color transfer-inhibiting active ingredients in washing textiles and detergents containing such compounds.

In addition to the ingredients essential for the washing process, such as surfactants and builder materials, detergents usually contain other ingredients which may be combined under the term "washing adjuvants" and include various groups of active ingredients, such as foam regulators, anti-redeposition agents, bleaching agents, bleach activators and enzymes. Such additives also include substances that should prevent dyed textiles from giving an altered color effect after being laundered. First, this change in color effect of washed textiles, i.e., clean textiles, may be based on the fact that dye constituents are removed from the textile by the washing process ("fading"), and secondly, dyestuffs released from textiles of different colors may be deposited on the textile ("discolored"). The discoloration aspect may also play a role with undyed laundry items, when they are washed together with colored laundry items. To avoid these unwanted side effects of the removal of dirt from textiles by treatment with aqueous systems, which usually contain surfactant, detergents (in particular when they are provided as so-called color detergents or detergents for colored wash for washing colored textiles) contain active ingredients which should prevent the release of dyestuffs from the textile or at least should prevent the deposition of released dyestuffs present in the washing liquid on textiles. Many of the polymers commonly used have such a high affinity for dyestuffs that they draw the dyes from the dyed fiber to an increased extent, thus resulting in increased color losses.

BRIEF SUMMARY OF THE INVENTION

It has surprisingly now been found that certain carboxylated triazine derivatives lead to unexpectedly high color transfer inhibition when used in detergents. Discoloration of white textiles or textiles of different colors due to dyestuffs washed out of textiles is prevented to an especially great extent. It is conceivable that the triazine derivatives defined below are absorbed onto the textiles in washing—possibly due to their carboxylic acid group content—and have a repellent effect on the dyestuff molecules present in the washing liquid.

The subject matter of the invention is therefore the use of triazine derivatives of general formulas I or II:

$$T(NH—Ar(CO_2M)_a)_bHal_c \quad (I)$$

$$X—NH—CH_2CH_2—(NY—CH_2CH_2—)_nNH—X \quad (II)$$

in which

T stands for a 1,3,5-triazinyl group,

Ar stands for a phenyl group,

M stands for H, Na, Li or K,

Hal stands for Cl, Br or I, a stands for 1, 2 or 3, b stands for 1 and c stands for 2 or b stands for 2 and c stands for 1, X stands for $T(NH—Ar(CO_2M)_a)_bHal_{c-1}$, Y stands for H or X, and n stands for a number from 0 to 50, to prevent the transfer of textile dyestuffs from dyed textiles to undyed textiles or textiles of different colors when they are washed together in aqueous solutions containing surfactant in particular.

Another subject matter of the invention is a color-protecting detergent containing a color transfer inhibitor in the form of a triazine derivative of the general formulas I or II defined above in addition to conventional ingredients compatible with this constituent.

DETAILED DESCRIPTION OF THE INVENTION

Triazine derivatives of general formula I are available by reaction of 2,4,6-trihalo-1,3,5-triazines with one or two equivalents of aminoaryl compound, whereby the aryl group of the aminoaryl compound has at least one carboxyl substituent. It is preferably a benzene unit with one to three carboxylic acid and/or carboxylate substituents. Aminoaryl compounds that may be used include, for example, 2-aminobenzoic acid, 3-aminobenzoic acid, 4-aminobenzoic acid, 3-amino-1,2-benzenedicarboxylic acid, 4-amino-1,2-benzenedicarboxylic acid, 2-amino-1,3-benzenedicarboxylic acid, 4-amino-1,3-benzenedicarboxylic acid, 5-amino-1,3-benzenedicarboxylic acid, 2-amino-1,4-benzenedicarboxylic acid, 4-amino-1,2,3-benzenetricarboxylic acid, 3-amino-1,2,4-benzenetricarboxylic acid, 5-amino-1,2,4-benzenetricarboxylic acid, 6-amino-1,2,4-benzenetricarboxylic acid and 2-amino-1,3,5-benzenetricarboxylic acid, whereby the carboxylic acid groups may also be present in salt form. Mixtures of said aminoaryl compounds may also be used.

By reacting two equivalents of such compounds according to formula I, having one or two halogens on the triazine radical, with one equivalent of ethylenediamine, compounds according to formula II, where n=0 are obtained. Instead of ethylenediamine, oligoethyleneimines and/or polyethyleneimines may also be used, whereby one additional equivalent of the compound according to formula I is then preferably used for each N atom in internal position on the oligoethyleneimine or polyethyleneimine. Preferred oligoethyleneimines and/or polyethyleneimines include those of the formula $NH_2—CH_2CH_2—(NH—CH_2CH_2—)_nNH_2$, in which n is a number from 1 to 30, in particular 2 to 20, whereby mixtures of oligoethyleneimines and/or polyethyleneimines of various degrees of oligomerization and/or polymerization may also be used, so that n may also assume nonintegral values as the average value.

With simultaneous use of various aminoaryl compounds and/or with simultaneous use of various oligoethyleneimines and/or polyethyleneimines, one easily obtains in the synthesis process described here compounds according to formula I or II, in which the respective variables a, b, c, n, X and Y are not always the same.

An inventive detergent preferably contains 0.05 wt % to 2 wt %, in particular 0.2 wt % to 1 wt % color transfer-inhibiting compound of general formula I and/or II. The "and/or" wording should make clear that joint use of compounds corresponding to one of said formulas is also possible.

The compounds of general formulas I or II make a contribution in the two aspects of color constancy mentioned above, i.e., they prevent both discoloration and fading, although the effect of preventing discoloration is most pronounced, in particular in washing white textiles. Another subject matter of the invention is therefore the use of a corresponding compound to prevent the change in the color effect of textiles when they are laundered in aqueous solutions containing surfactant in particular. The change in color effect is by no means to be understood as the difference between soiled and clean textile, but instead it is the difference between clean textile before the washing process and clean textile after the washing process.

Another subject matter of the invention is a method for washing dyed textiles in aqueous solutions containing surfactant, which is characterized in that an aqueous solution containing a surfactant and a compound of general formula I and/or II is used. In such a method, it is also possible to wash white and/or undyed textiles together with the dyed textile without discoloration of the white and/or undyed textile.

An inventive detergent may, if desired, contain a known color transfer inhibitor, preferably in amounts of 0.1 wt % to 2 wt %, in particular 0.2 wt % to 1 wt %, in addition to the compound according to formula I or II; in a preferred embodiment of the invention, this is a polymer of vinylpyrrolidone, vinylimidazole, vinylpyridine-N-oxide or a copolymer thereof. It is also possible to use the polyvinylpyrrolidones with molecular weights of 15,000 to 50,000 known from European Patent Application EP 0 262 897, for example, and the polyvinylpyrrolidones with molecular weights of more than 1,000,000, in particular from 1,500,000 to 4,000,000, known from International Patent Application WO 95/06098, the N-vinylimidazole/N-vinylpyrrolidone copolymers known from German Patent Applications DE 28 14 287 or DE 38 03 630 or International Patent Applications WO 94/10281, WO 94/26796, WO 95/03388 and WO 95/03382, the polyvinyloxazolidones known from German Patent Application DE 28 14 329, the copolymers based on vinyl monomers and carboxylic acid amides known from European Patent Application EP 610 846, the polyesters and polyamides containing pyrrolidone group(s) known from International Patent Application WO 95/09194, the grafted polyamidoamines and polyethyleneimines known from International Patent Application WO 94/29422, the polymers with amide groups from secondary amines known from German Patent Application DE 43 28 254, the polyamine-N-oxide polymers known from International Patent Application WO 94/02579 or European Patent Application EP 0 135 217, the polyvinyl alcohols known from European Patent Application EP 0 584 738 and the copolymers based on acrylamidoalkenylsulfonic acids known from European Patent Application EP 0 584 709. However, enzymatic systems comprising a peroxidase and hydrogen peroxide and/or a substance that supplies hydrogen peroxide in water, such as those known from International Patent Applications WO 92/18687 and WO 91/05839, for example, may also be used. The addition of a mediator compound for peroxidase, for example, an acetosyringone known from International Patent Application WO 96/10079, a phenol derivative known from International Patent Application WO 96/12845 or a phenothiazine or phenoxazine known from International Patent Application WO 96/12846 is preferred in this case, whereby aforementioned polymeric color transfer inhibitor active ingredients may also be used in addition. Polyvinylpyrrolidone preferably has an average molecular weight in the range of 10,000 to 60,000, in particular in the range of 25,000 to 50,000, for use in inventive detergents. Of the copolymers, those of vinylpyrrolidone and vinylimidazole in a molar ratio of 5:1 to 1:1 with an average molecular weight in the range of 5000 to 50,000, in particular 10,000 to 20,000, are preferred.

The inventive detergents, which may be in the form of powdered solids in particular, in a postdensified particulate form, as homogeneous solutions or suspensions, may also in principle contain all known ingredients conventionally used in such agents, in addition to the active ingredient used according to the invention. The inventive detergents may contain in particular builder substances, surface-active agents, bleaching agents based on organic and/or inorganic peracid compounds, bleach activators, water-miscible organic solvents, enzymes, sequestrants, electrolytes, pH regulators and other additives such as optical brighteners, anti-redeposition agents, foam regulators as well as dyestuffs and fragrances.

The inventive detergents may contain one or more surfactants, whereby anionic surfactants, nonionic surfactants and mixtures thereof may be considered in particular, but also cationic, zwitterionic and amphoteric surfactants.

Suitable nonionic surfactants include in particular alkyl glycosides and ethoxylation products and/or propoxylation products of alkyl glycosides or linear or branched alcohols, each with 12 to 18 carbon atoms in the alkyl part and 3 to 20 alkyl ether groups, preferably 4 to 10 alkyl ether groups. In addition, corresponding ethoxylation and/or propoxylation products of N-alkylamines, vicinal diols, fatty acid esters and fatty acid amides, which correspond to said long-chain alcohol derivatives with regard to the alkyl part, as well as alkylphenols with 5 to 12 carbon atoms in the alkyl radical may be used.

The nonionic surfactants used are preferably alkoxylated, advantageously ethoxylated alcohols, in particular primary alcohols with preferably 8 to 18 carbon atoms and an average of 1 to 12 mol ethylene oxide (EO) per mol alcohol, in which the alcohol radical may be linear or preferably methyl-branched in position 2 and/or may contain linear and methyl-branched radicals in mixture, such as those usually present in the oxo alcohol radicals. In particular, however, alcohol ethoxylates with linear radicals from alcohols of native origin with 12 to 18 carbon atoms, e.g., from coconut, palm, tallow fat or oleyl alcohol and an average of 2 to 8 EO per mol alcohol are preferred. The preferred ethoxylated alcohols include, for example, $C_{12}$-$C_{14}$ alcohols with 3 EO or 4 EO, $C_9$-$C_{11}$ alcohols with 7 EO, $C_{13}$-$C_{15}$ alcohols with 3 EO, 5 EO, 7 EO or 8 EO, $C_{12}$-$C_{18}$ alcohols with 3 EO, 5 EO or 7 EO and mixtures thereof, such as a mixtures of $C_{12}$-$C_{14}$ alcohol with 3 EO and $C_{12}$-$C_{18}$ alcohol with 7 EO. The stated degrees of ethoxylation are statistical averages, which may be an integer or a fraction for a specific product. Preferred alcohol ethoxylates have a narrow homolog distribution (narrow range ethoxylates, NRE). In addition to these nonionic surfactants, fatty alcohols with more than 12 EO may also be used. Examples include (tallow) fatty alcohols with 14 EO, 16 EO, 20 EO, 25 EO, 30 EO or 40 EO. Extremely low-sudsing compounds are generally used in detergents for use in machine methods in particular. These preferably include $C_{12}$-$C_{18}$ alkyl polyethylene glycol-polypropylene glycol ethers, each with up to 8 mol ethylene oxide units and propylene oxide units in the molecule. However, other known low-sudsing nonionic surfactants may also be used, e.g., $C_{12}$-$C_{18}$ alkyl polyethylene glycol-polybutylene glycol ethers, each with up to 8 mol ethylene oxide units and butylene oxide units in the molecule as well as end-group-capped alkylpolyalkylene glycol mixed ethers. The hydroxyl group-containing alkoxylated alcohols such as those described in European Patent Application EP 0 300 305, so-called hydroxy mixed ethers, are especially preferred. The nonionic surfactants also include alkyl glycosides of the general formula $RO(G)_x$, in which R denotes a primary linear or methyl-branched aliphatic radical, in particular with methyl branching in position 2, with 8 to 22 carbon atoms, preferably 12 to 18 carbon atoms, and G stands for a glucose unit with 5 or 6 carbon atoms, preferably glucose. The degree of oligomerization x, which indicates the distribution of monoglycosides and oligoglycosides, is any number—which may also assume fractional values as a quantity to be determined by analysis—between 1 and 10; x is preferably 1.2 to 1.4. Also suitable are polyhydroxy fatty acid amides of formula III, in which $R^1CO$ stands for an aliphatic acyl radical with 6 to 22 carbon atoms, $R^2$ stands for hydrogen, an alkyl radical or a hydroxyalkyl radical with 1 to 4 carbon atoms and [Z] stands for a linear or branched polyhydroxyalkyl radical with 3 to 10 carbon atoms and 3 to 10 hydroxyl groups:

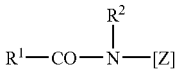

(III)

The polyhydroxy fatty acid amides are preferably derived from reducing sugars with 5 or 6 carbon atoms, in particular from glucose. The group of polyhydroxy fatty acid amides also includes compounds of formula IV:

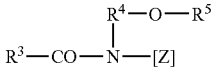

(IV)

in which $R^3$ stands for a linear or branched alkyl or alkenyl radical with 7 to 12 carbon atoms, $R^4$ stands for a linear, branched or cyclic alkylene radical or an arylene radical with 2 to 8 carbon atoms, and $R^5$ stands for a linear, branched or cyclic alkyl radical or an acyl radical with an oxyalkyl radical with 1 to 8 carbon atoms, whereby $C_1$-$C_4$ alkyl or phenyl radicals are preferred, and [Z] stands for a linear polyhydroxyalkyl radical whose alkyl chain is substituted with at least two hydroxyl groups, or alkoxylated, preferably ethoxylated or propoxylated derivatives of this radical. Here again, [Z] is preferably obtained by reductive amination of a sugar such as glucose, fructose, maltose, lactose, galactose, mannose or xylose. The N-alkoxy-substituted compounds or N-aryloxy-substituted compounds may then be converted to the desired polyhydroxy fatty acid amides, for example, according to the teaching of International Patent Application WO 95/07331 by reaction with fatty acid methyl esters in the presence of an alkoxide as catalyst. Another class of nonionic surfactants that are preferably used either as the sole nonionic surfactant or in combination with other nonionic surfactants, in particular with alkoxylated fatty alcohols and/or alkyl glycosides, are alkoxylated, preferably ethoxylated or ethoxylated and propoxylated fatty acid alkyl esters, preferably with 1 to 4 carbon atoms in the alkyl chain, in particular fatty acid methyl esters as described in Japanese Patent Application JP 58/217598, for example, or preferably produced by the method described in International Patent Application WO 90/13533. Nonionic surfactants of the amine oxide type, e.g., N-coco alkyl-N,N-dimethylamine oxide and N-tallow alkyl-N,N-dihydroxyethylamine oxide, and the fatty acid alkanolamides may be suitable. The amount of these nonionic surfactants is preferably no more than the amount of ethoxylated fatty alcohols, in particular no more than half thereof. So-called gemini surfactants may be used as additional surfactants. These are understood in general to include those compounds having two hydrophilic groups per molecule. These groups are usually separated from one another by a so-called spacer. This spacer is usually a carbon chain, which should be long enough that the hydrophilic groups have a sufficient distance between them to be able to act independently of one another. Such surfactants are characterized in general by an unusually low critical micelle concentration and the ability to greatly reduce the surface tension of water. In exceptional cases, the term gemini surfactants is understood to include not only such "dimeric" surfactants but also "trimeric" surfactants. Suitable gemini surfactants include, for example, sulfated hydroxy mixed ethers according to German Patent Application DE 43 21 022 or dimeric alcohol bis-sulfates and trimeric alcohol tris-sulfates and ether sulfates according to German Patent Application DE 195 03 061. Terminal group-capped dimeric and trimeric mixed ethers according to German Patent Application DE 195 13 391 are characterized in particular by their bifunctionality and multifunctionality. Thus the aforementioned end group-capped surfactants have good wetting properties and are low-sudsing so that they are suitable in particular for use in machine washing or cleaning processes. However, gemini polyhydroxy fatty acid amides or polypolyhydroxy fatty acid amides such as those produced according to International Patent Applications WO 95/19953, WO 95/19954 and U.S. Pat. No. 3,234,258 or U.S. Pat. No. 5,075,041 and obtainable as commercial products of Shell Oil Company under the name DAN® are suitable anionic surfactants. The sulfuric acid monoesters of linear or branched $C_7$-$C_{21}$ alcohols ethoxylated with 1 to 6 mol ethylene oxide, e.g., 2-methyl-branched $C_9$-$C_{11}$ alcohols with an average of 3.5 mol ethylene oxide (EO) or $C_{12}$-$C_{18}$ fatty alcohols with 1 to 4 EO are also suitable. The preferred anionic surfactants also include the salts of alkylsulfosuccinic acid, which are also known as sulfosuccinates or sulfosuccinic acid esters, and the monoesters and/or diesters of sulfosuccinic acid with alcohols, preferably fatty alcohols and in particular ethoxylated fatty alcohols. Preferred sulfosuccinates contain $C_8$ to $C_{18}$ fatty alcohol radicals or mixtures thereof. Especially preferred sulfosuccinates contain a fatty alcohol radical derived from ethoxylated fatty alcohols, which are nonionic surfactants when considered separately. Sulfosuccinates whose fatty alcohol radicals are derived from ethoxylated fatty alcohols with a narrow homolog distribution are especially preferred. It is likewise also possible to use alk(en)ylsuccinic acid with preferably 8 to 18 carbon atoms in the alk(en)yl chain or their salts. Additional anionic surfactants that may be considered include fatty acid derivatives of amino acids, e.g., of N-methyltaurine (taurides) and/or of N-methyl glycine (sarcosides). The sarcosides and/or sarcosinates are preferred in particular, especially sarcosinates of higher fatty acids and optionally monounsaturated or polyunsaturated fatty acids, such as oleyl sarcosinate. Other anionic surfactants that may be used include soaps in particular. Saturated fatty acid soaps, such as the salts of lauric acid, myristic acid, palmitic acid, stearic acid, hydrogenated erucic acid and behenic acid as well as in particular soap mixtures derived from natural fatty acids, e.g., coconut, palm kernel or tallow fatty acids. The known alkenylsuccinic acid salts may also be used together with these soaps or as a substitute for soaps.

The anionic surfactants, including the soaps, may be present in the form of their sodium salts, potassium salts or ammonium salts as well as soluble salts of organic bases, such as monoethanolamine, diethanolamine or triethanolamine.

The anionic surfactants are preferably in the form of their sodium or potassium salts, in particular in the form of the sodium salts.

Surfactants are present in inventive detergents in amounts of preferably 5 wt % to 50 wt %, in particular from 8 wt % to 30 wt %.

An inventive detergent preferably contains at least one water-soluble and/or water-insoluble organic and/or inorganic builder. The water-soluble organic builder substances include polycarboxylic acids, in particular citric acid and sugar acids, monomeric and polymeric aminopolycarboxylic acids, in particular methyl glycine diacetic acid, nitrilotriacetic acid and ethylenediamine-tetraacetic acid as well as polyaspartic acid, polyphosphonic acids, in particular aminotris (methylenephosphonic acid), ethylenediaminetetrakis (methylenephosphonic acid) and 1-hydroxyethane-1,1-diphosphonic acid, polymeric hydroxyl compounds, such as dextrin, and polymeric (poly)carboxylic acids, in particular the polycarboxylates accessible by oxidation of polysaccharides and/or dextrins according to European Patent EP 0 625 992 and/or International Patent Application WO 92/18542 or European Patent Application EP 0 232 202, polymeric acrylic acids, methacrylic acids, maleic acids and copolymers thereof, which may also contain small amounts of polymerizable substances without a carboxylic acid functionality polymerized into them. The relative molecular weight of the homopolymers of unsaturated carboxylic acids is generally between 3000 and 200,000, that of the copolymer is between 2000 and 200,000, preferably 30,000 to 120,000, each based on the free acid. An especially preferred acrylic acid-maleic acid copolymer has a relative molecular weight of 30,000 to 100,000. Commercial products include, for example, Sokalan® CP 5, CP 10 and PA 30 from the company BASF. Suitable, although less preferred, compounds of this class include the copolymers of acrylic acid or methacrylic acid with vinyl ethers, such as vinyl methyl ethers, vinyl esters, ethylene, propylene and styrene, in which the amount of acid is at least 50 wt %. Terpolymers containing two unsaturated acids and/or their salts as the monomers and vinyl alcohol and/or an esterified vinyl alcohol or a carbohydrate as the third monomer may also be used as the water-soluble organic builder substances. The first acid monomer and/or its salt is derived from a monoethylenically unsaturated $C_3$-$C_8$ carboxylic acid and preferably from a $C_3$-$C_4$ monocarboxylic acid, in particular (meth)acrylic acid. The second acid monomer and/or its salt may be a derivative of a $C_4$-$C_8$ dicarboxylic acid, maleic acid being especially preferred, and/or a derivative of an alkylsulfonic acid substituted with an alkyl or aryl radical in position 2. Such polymers can be produced in particular by methods described in German Patent DE 42 21 381 and German Patent Application DE 43 00 772 and in general they have a relative molecular weight between 1000 and 200,000. Other preferred copolymers are those described in German Patent Applications DE 43 03 320 and DE 44 17 734 and having as the monomers preferably acrolein and acrylic acid/acrylic acid salts and/or vinyl acetate. The organic builder substances may be used in the form of aqueous solutions, preferably in the form of 30 wt % to 50 wt % aqueous solutions for production of liquid detergents in particular. All the aforementioned acids are usually used in the form of their water-soluble salts, in particular their alkali salts.

Such organic builder substances may be present in amounts of up to 40 wt %, if desired, in particular up to 25 wt % and preferably from 1 wt % to 8 wt %. Amounts close to the aforementioned upper limit are preferably used in paste or liquid inventive detergents, in particular aqueous inventive detergents.

Water-soluble inorganic builder materials may include in particular alkali silicates, alkali carbonates and alkali phosphates, which may be present in the form of their alkaline, neutral or acidic sodium or potassium salts. Examples include trisodium phosphate, tetrasodium diphosphate, disodium dihydrogen diphosphate, pentasodium triphosphate, so-called sodium hexametaphosphate, oligomeric trisodium phosphate with degrees of oligomerization of 5 to 1000, in particular 5 to 50, as well as the corresponding potassium salts and/or mixtures of sodium and potassium salts. In particular crystalline or amorphous alkali aluminosilicates are used as the water-insoluble, water-dispersible inorganic builder materials in amounts of up to 50 wt %, preferably no more than 40 wt %, and in liquid detergents in particular, from 1 wt % to 5 wt %. Of these, the crystalline sodium aluminosilicates of detergent quality, in particular zeolite A, zeolite P and optionally zeolite X, alone or in mixtures, e.g., in the form of a co-crystallizate of zeolite A and zeolite X (Vegobond® AX, a commercial product of Condea Augusta S.p.A.) are preferred. Amounts close to the aforementioned upper limit are preferably used in solid, particulate detergents. Suitable aluminosilicates in particular do not have any particles with a grain size of more than 30 μm and preferably consist of at least 80% particles with a size of less than 10 μm. Their calcium binding capacity, which can be determined according to the instructions in German Patent DE 24 12 837, is usually in the range of 100 to 200 mg CaO per gram.

Suitable substitutes and/or partial substitutes for the aforementioned aluminosilicate include crystalline alkali silicates, which may be present alone or in mixture with amorphous silicates. The alkali silicates that may be used as builder substances in the inventive detergents preferably have a molar ratio of alkali oxide to $SiO_2$ of less than 0.95, in particular of 1:1.1 to 1:12, and may be amorphous or crystalline. Preferred alkali silicates include the sodium silicates, in particular the amorphous sodium silicates with a molar ratio $Na_2O:SiO_2$ of 1:2 to 1:2.8. Such compounds with a molar ratio $Na_2O:SiO_2$ of 1:1.9 to 1:2.8 can be produced by the method according to European Patent Application EP 0 425 427. The crystalline silicates, which may be used alone or in mixture with amorphous silicates, are preferably crystalline layered silicates of the general formula $Na_2Si_xO_{2x+1}.yH_2O$, in which x, the so-called modulus, has a number from 1.9 to 22, in particular 1.9 to 4, and y is a number from 0 to 33, and the preferred values for x are 2, 3 or 4. Crystalline layered silicates which fall under this general formula are described in European Patent Application EP 0 164 514, for example. Preferred crystalline layered silicates are those in which x in the aforementioned general formula assumes values of 2 or 3. In particular, β- and δ-sodium disilicates ($Na_2Si_2O_5.yH_2O$) are preferred, whereby β-sodium disilicate can be obtained, for example, by the method described in International Patent Application WO 91/08171. δ-Sodium silicates with a modulus between 1.9 and 3.2 can be produced according to Japanese Patent Applications JP 04/238 809 or JP 04/260 610. Practically anhydrous crystalline alkali silicates of the general formula given above, which are produced from amorphous alkali silicates and in which x is a number from 1.9 to 2.1, can be produced as described in the European Patent Applications EP 0 548 599, EP 0 502 325 and EP 0 452 428 and may be used in the inventive detergents. In another preferred embodiment of inventive detergents, a crystalline layered sodium silicate with a modulus of 2 to 3 is used, such as that which can be produced from sand and soda by the method according to European Patent Application EP 0 436 835. Crystalline sodium silicates with a modulus in the range of 1.9 to 3.5, such as those obtainable by the methods of European Patents EP 0 164 552 and/or EP 0 294 753 are used in another preferred embodiment of inventive detergents. Crystalline layered silicates of formula (I) given above are distributed by the company Clariant GmbH under the brand name Na-SKS, e.g., Na-SKS-1 ($Na_2Si_{22}O_{45}.xH_2O$, kenyaite), Na-SKS-2 ($Na_2Si_{14}O_{29}.xH_2O$, magadiite), Na-SKS-3 ($Na_2Si_8O_{17}.xH_2O$) or Na-SKS-4 ($Na_2Si_4O_9.xH_2O$, makatite). Of these, in particular Na-SKS-5 ($\alpha$-($Na_2Si_2O_5$), Na-SKS-7 ($\beta$-$Na_2Si_2O_5$, natrosilite), Na-SKS-9 ($NaHSi_2O_5.3H_2O$), Na-SKS-10 ($NaHSi_2O_5.3H_2O$, kanemite), Na-SKS-11 ($\delta$-$Na_2Si_2O_5$) and Na-SKS-13 ($NaHSi_2O_5$), but in particular Na-SKS-6 ($\delta$-$Na_2Si_2O_5$) are suitable. The article published in Hoechst High Chem Magazine 14/1993, pages 33-38 and in Seifen-Öle-Fette-Wachse, vol. 116, no. 20/1990, pages 805-808 give a review of crystalline layered silicates. In a preferred embodiment of inventive detergents, a granular compound of crystalline layered silicate and citrate, of crystalline layered silicate and the aforementioned (co)polymeric polycarboxylic acid as described in German Patent Application DE 198 19 187, for example, or of alkali silicate and alkali carbonate is used as described in International Patent Application WO 95/22592, for example, or as obtainable commercially under the brand name Nabion® 15, for example.

Builder substances are contained in the inventive detergents preferably in amounts of up to 75 wt %, in particular 5 wt % to 50 wt %.

Suitable peroxygen compounds for use in inventive detergents include in particular organic peracids and/or peracid salts of organic acids such as phthalimidopercaproic acid, perbenzoic acid or salts of diperdodecanedioic acid, hydrogen peroxide and inorganic salts that release hydrogen peroxide under washing conditions, including perborate, percarbonate, persilicate and/or persulfate as well as caroate. If solid peroxygen compounds are to be used, they may be used in the form of powders or granules, which may also be sheathed by essentially known methods. If an inventive detergent contains peroxygen compounds, they are present in amounts of preferably up to 50 wt %, in particular from 5 wt % to 30 wt %. The addition of small amounts of known bleach stabilizers, e.g., phosphonates, borates and/or metaborates and metasilicates as well as magnesium salts such as magnesium sulfate may be expedient.

Compounds that yield aliphatic peroxycarboxylic acids with preferably 1 to 10 carbon atoms, in particular 2 to 4 carbon atoms, under perhydrolysis conditions and/or optionally substituted perbenzoic acid may be used as bleach activators. Substances having O- and/or N-acyl groups of the aforementioned number of carbon atoms and/or optionally substituted benzoyl groups are suitable. Polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinimide (NOSI), acylated phenolsulfonates, in particular n-nonanoyl- or isononanoyl-oxybenzenesulfonate (n- or iso-NOBS), carboxylic acid anhydrides in particular phthalic acid anhydride, acylated polyvalent alcohols, in particular triacetin, ethylene glycol diacetate, 2,5-diacetoxy-2,5-dihydrofuran and the enol esters known from the German Patent Applications DE 196 16 693 and DE 196 16 767 as well as acetylated sorbitol and mannitol and/or their mixtures (SORMAN), as described in European Patent Application EP 0 525 239, acylated sugar derivatives, in particular pentaacetylglucose (PAG), pentaacetyl-fructose, tetraacetylxylose and octaacetyllactose as well as acetylated, optionally N-alkylated glucamine and gluconolactone and/or N-acylated lactams, e.g., N-benzoylcaprolactam, which are known from International Patent Applications WO 94/27970, WO 94/28102, WO 94/28103, WO 95/00626, WO 95/14759 and WO 95/17498 are preferred. The hydrophilically substituted acylacetals known from German Patent Application DE 196 16 769 and the acyllactams described in German Patent Application DE 196 16 770 and International Patent Application WO 95/14075 are also preferred for use. The combinations of conventional bleach activators known from German Patent Application DE 44 43 177 may also be used. Such bleach activators may be contained in the usual quantity range, preferably in amounts of 0.5 wt % to 10 wt %, in particular 1 wt % to 8 wt %, based on the total detergent, especially in the presence of the above-mentioned bleaching agents, which supply hydrogen peroxide, but they are preferably omitted entirely when using percarboxylic acid as the only bleaching agent.

In addition to or instead of the conventional bleach activators, the sulfonamides and/or bleach-enhancing transition metal salts and/or transition metal complexes known from European Patents EP 0 446 982 and EP 0 453 003 may also be used as so-called bleach catalysts.

Enzymes that may be used in the detergents include those from the class of amylases, proteases, lipases, cutinases, pullulanases, hemicellulases, cellulases, oxidases, laccases and peroxidases as well as mixtures thereof. Especially suitable enzymatic active ingredients are those obtained from fungi/yeasts or bacteria, such as *Bacillus subtilis, Bacillus licheniformis, Bacillus lentus, Streptomyces griseus, Humicola lanuginosa, Humicola insolens, Pseudomonas pseudoalcaligenes, Pseudomonas cepacia* or *Coprinus cinereus*. The enzymes may be adsorbed onto carrier substances as described in European Patent EP 0 564 476, for example, or in International Patent Application WO 94/23005 and/or they may be embedded in sheathing substances to protect them from premature inactivation. They are used in the detergents or cleaning agents according to the invention preferably in amounts up to 5 wt %, in particular from 0.2 wt % to 4 wt %. If the inventive detergent contains protease, it preferably has a proteolytic activity in the range from approximately 100 PE/g to approximately 10,000 PE/g, in particular 300 PE/g to 8000 PE/g. If several enzymes are to be used in the inventive detergents, this may be accomplished by incorporating the two or more separate enzymes and/or enzymes finished separately in a known way or by two or more enzymes formulated jointly in granules, as is known from International Patent Applications WO 96/00772 or WO 96/00773, for example.

Organic solvents usable in the inventive detergents, in particular when they are in liquid or pasty form, in addition to water include alcohols with 1 to 4 carbon atoms, in particular methanol, ethanol, isopropanol and tert-butanol, diols with 2 to 4 carbon atoms, in particular ethylene glycol and propylene glycol, as well as mixtures thereof and the ethers derivable from said compound classes. Such water-miscible solvents are preferably present in the inventive detergents in amounts of no more than 30 wt %, in particular from 6 wt % to 20 wt %.

To adjust a desired pH that is not established automatically from mixing the other components, the inventive detergents may contain system-compatible and environmentally tolerable acids, in particular citric acid, acetic acid, tartaric acid, malic acid, lactic acid, glycolic acid, succinic acid, glutaric acid and/or adipic acid, but also mineral acids, in particular sulfuric acid, or bases, in particular ammonium hydroxide or alkali hydroxide. Such pH regulators are contained in the inventive detergents in amounts of preferably no more than 20 wt %, in particular from 1.2 wt % to 17 wt %.

Anti-redeposition agents have the task of keeping the dirt released from the textile fibers suspended in the washing liquid. These include water-soluble colloids, usually of an organic nature, e.g., starch, glue, gelatin, salts of ether carboxylic acids or ether sulfonic acids of starch or cellulose or salts of acidic sulfuric acid esters of cellulose or starch. Water-soluble polyamides containing acid groups are also suitable for this purpose. In addition, starch derivatives other than those mentioned above may also be used, e.g., aldehyde starches. Cellulose ethers, such as carboxymethylcellulose (sodium salt), methylcellulose, hydroxyalkylcellulose and mixed ethers such as methylhydroxyethylcellulose, methylhydroxypropylcellulose, methylcarboxymethylcellulose and mixtures thereof e.g., in amounts of 01 wt % to 5 wt %, based on the detergents, may also be used.

Inventive textile detergents may contain, for example, derivatives of diaminostilbenedisulfonic acid and/or their alkali metal salts as optical brighteners, although they are preferably free of optical brighteners for use as detergents for colored wash. For example, salts of 4,4'-bis(2-anilino-4-morpholino-1,3,5-triazinyl-6-amino)stilbene-2,2'-disulfonic acid or similarly structured compounds having a diethanolamino group, a methylamino group, an anilino group or a 2-methoxyethylamino group instead of the morpholino group are suitable. In addition, brighteners of the substituted diphenylstyryl type may also be present, e.g., the alkali salts of 4,4'-bis(2-sulfostyryl)diphenyl, 4,4'-bis(4-chloro-3-sulfostyryl)diphenyl or 4-(4-chlorostyryl)-4'-(2-sulfostyryl)diphenyl. Mixtures of the aforementioned optical brighteners may also be used.

It may be advantageous to add conventional foam inhibitors to the detergents for use in machine methods in particular. Suitable foam inhibitors include, for example, soaps of natural or synthetic origin having a high $C_{18}$-$C_{24}$ fatty acid content. Suitable nonsurfactant foam inhibitors include, for example, organopolysiloxanes and mixtures thereof with microfine, optionally silanized silica as well as paraffins, waxes, microcrystalline waxes and mixtures thereof with silanized silica or bis-fatty acid alkylenediamides. Mixtures of various foam inhibitors are also used to advantage, e.g., those of silicones, paraffins or waxes. The foam inhibitors, in particular foam inhibitors containing silicone and/or paraffin, are preferably bound to a granular, water-soluble and/or water-dispersible carrier substance. In particular mixtures of paraffins and bis-stearylethylenediamide are preferred.

The production of the inventive solid detergents does not pose any problems and can be accomplished by known methods, e.g., by spray drying or granulation, whereby enzymes and possibly other thermally sensitive ingredients, e.g., bleaching agents may optionally be added separately later. To produce inventive detergents with an increased bulk density, in particular in the range of 650 g/L to 950 g/L, a method which is known from European Patent EP 0 486 592 and includes an extrusion step is preferred. Another preferred production with the help of a granulation method is described in European Patent EP 0 642 576.

To produce inventive detergents in tablet form, which may be single-phase or multiphase, monochromatic or polychromatic and in particular may comprise one or more layers, in particular two layers, it is preferable to proceed by mixing all the constituents—optionally one constituent per layer—in a mixer and pressing the mixture using traditional tablet presses, e.g., eccentric presses or rotary presses with pressing forces in the range of approximately 50 kN to 100 kN, preferably 60 kN to 70 kN. With multilayered tablets in particular, it may be advantageous if at least one layer is prepressed. This is preferably performed with pressing forces between 5 kN and 20 kN, in particular 10 kN to 15 kN. This yields with no problem break-resistant tablets which nevertheless dissolve with sufficient speed under use conditions and have breaking and bending strength values of normally 100 to 200 N, but preferably more than 150 N. A tablet produced in this way preferably has a weight of 10 g to 50 g, in particular 15 g to 40 g. Any three-dimensional shape of the tablets may be used; it may round, oval or angular, and intermediate shapes are also possible. Corners and edges are advantageously rounded. Round tablets preferably have a diameter of 30 mm to 40 mm. The size of tablets with a polygonal or cuboid shape, which are added into dishwashing machines, for example, primarily via the metering device, depends on the geometry and volume of this metering device. For example, preferred embodiments have a base area of (20 to 30 mm)×(34 mm to 40 mm), in particular 26×36 mm or 24×38 mm.

Liquid and/or pasty inventive detergents in the form of solutions containing conventional solvents are usually prepared by simple mixing of the ingredients, which may be placed in an automatic mixer as solids or in solution.

EXAMPLES

Example 1

Preparation of 2,4-bis(3-carboxyphenylamino)-6-chloro-triazine

Cyanuric chloride (13.6 g, 0.073 mol) suspended in a mixture of ice and acetone (50 mL) was added to a stirred aqueous solution of 3-aminobenzoic acid (20 g, 0.146 mol) at pH 8 (sodium carbonate) at 0° C. to 5° C. The mixture was stirred for 5 hours at this temperature, then heated to 30° C. and stirred for another 16 hours at 30° C. Phosphate buffer mixture (pH 6.5, 2 g) and then acetone were added. The colorless solid precipitate was separated (yield 49 g, 46.7% purity).

Example 2

Preparation of 2,4-bis(3,5-dicarboxyphenylamino)-6-chloro-triazine

5-Aminoisophthalic acid (98%, 20 g, 0.108 mol) was dissolved in a mixture of water (200 mL) and ice (20 g) and sodium hydroxide. A freshly prepared suspension of cyanuric chloride (10 g, 0.054 mol) in ice/acetone (approximately 50 mL) was added at 0° C. to 5° C. while stirring and the pH was kept at 6.5. After 4 hours, the mixture was heated to 30° C. and the temperature was kept there for 16 hours at pH 6.5. Phosphate buffer mixture and then acetone were added. The colorless solid precipitate was separated (yield 57 g, 53% purity).

Example 3

Preparation of N,N'-bis-[2-chloro(3,5-dicarboxyphenylamino)triazin-6-ylamino]-1,2-diaminoethane 5-Aminoisophthalic acid (15.4 g) was reacted with one molar equivalent cyanuric chloride at 0° C. to 5° C., as described in Example 2. To the resulting solution of 2,4-bis(3,5-dicarboxyphenylamino)-6-chlorotriazine was added 1,2-diaminoethane, and the reaction mixture was stirred for 4 hours a pH of 8 and at a temperature of 30° C. Acetone was added while stirring and the precipitated product was separated (yield 22.1 g, 56% purity).

Example 4

Preparation of N,N'-bis-[2-chloro-(3-carboxyphenylamino)triazin-6-ylamino]-1,2-diaminoethane Otherwise the same as described in Example 3, but using 3-aminobenzoic acid (11.5 g) instead of 5-aminoisophthalic acid, the former was reacted with cyanuric chloride (15.4 g) at 0° C. to 5° C. To the resulting solution of 4,6-dichloro-6-(3-carboxyphenylamino)triazine was added 1,2-diaminoethane, and the reaction mixture was stirred for 4 hours at pH 8 and at 30° C. to 35° C. Acetone was added while stirring, and the precipitated product was separated (yield 20.2 g, 59% purity).

Example 5

Preparation of N-poly(4-chloro-6-[3,5-dicarboxyphenylamino]triazinyl)polyethyleneimine As described in Example 2, 5-aminoisophthalic acid (10 g) was reacted with cyanuric chloride at 0° C. to 5° C. Oligomeric ethyleneimine (2.9 g, average molecular weight 432) was added to the resulting solution of 2-(3,5-dicarboxyphenylamino)-4,6-dichlorotriazine and the reaction mixture was stirred for 6 hours at 35° C. Workup as described yielded 17.5 g product.

Example 6

Each of the triazine derivatives prepared in Examples 1 to 5 was forcibly applied to white cotton textiles by immersion with the help of an aqueous solution and the white textile was then washed with dyed textiles at 60° C. using a color transfer inhibitor-free powder detergent.

The white textiles were not discolored and the color washed out remained completely in the washing liquid.

What is claimed is:

1. A detergent composition comprising a color transfer inhibitor and a polymer of vinylpyrrolidone, vinylimidazole, vinylpyridine-N-oxide or a copolymer thereof, the color transfer inhibitor comprising one or more compounds selected from the group consisting of triazine derivatives corresponding to general formulae I and II:

$$T(NH—Ar(CO_2M)_a)_bHal_c \quad (I)$$

$$X—NH—CH_2CH_2—(NY—CH_2CH_2—)_nNH—X \quad (II)$$

wherein T represents a 1,3,5-triazinyl group; Ar represents a phenyl group; each M independently represents a substituent selected from the group consisting of H, Na, Li, and K; each Hal independently represents a halogen selected from the group consisting of Cl, Br, and I; each a independently represents 1, 2 or 3; b and c each represent 1 or 2 wherein b+c=3; each X represents a $T(NH—Ar(CO_2M)_a)_bHal_{c-1}$ group; each Y independently represents H or X; and n represents a number of 0 to 50.

2. The detergent composition according to claim 1, wherein the color transfer inhibitor comprises a triazine derivative corresponding to the general formula I which is prepared by reacting a 2,4,6-trihalo-1,3,5-triazine with 1 or 2 equivalents of an aminoaryl compound, wherein the aminoaryl compound comprises an aryl group having at least one carboxyl substituent.

3. The detergent composition according to claim 1, wherein the color transfer inhibitor comprises a triazine derivative corresponding to the general formula II which is prepared by reacting two equivalents of a compound corresponding to the general formula I with an amine reactant selected from the group consisting of 1,2-diaminoethane, oligoethyleneimines, polyethyleneimines and mixtures thereof.

4. The detergent composition according to claim 3, wherein the amine reactant comprises an oligoethyleneimine or polyethyleneimine corresponding to the formula $NH_2—CH_2CH_2—(NH—CH_2CH_2—)_nNH_2$, wherein n is a number of 1 to 30.

5. The detergent composition according to claim 3, wherein the amine reactant comprises an oligoethyleneimine or polyethyleneimine corresponding to the formula $NH_2—CH_2CH_2—(NH—CH_2CH_2—)_nNH_2$, wherein n is a number of 2 to 20.

6. The detergent composition according to claim 2, wherein the aminoaryl compound is selected from the group consisting of 2-aminobenzoic acid, 3-aminobenzoic acid, 4-aminobenzoic acid, 3-amino-1,2-benzenedicarboxylic acid, 4-amino-1,2-benzenedicarboxylic acid, 2-amino-1,3-benzenedicarboxylic acid, 4-amino-1,3-benzenedicarboxylic acid, 5-amino-1,3-benzenedicarboxylic acid, 2-amino-1,4-benzenedicarboxylic acid, 4-amino-1,2,3-benzenetricarboxylic acid, 3-amino-1,2,4-benzenetricarboxylic acid, 5-amino-1,2,4-benzenetricarboxylic acid, 6-amino-1,2,4-benzenetricarboxylic acid and 2-amino-1,3,5-benzenetricarboxylic acid, carboxylate salts thereof, and mixtures thereof.

7. The detergent composition according to claim 1, wherein the one or more compounds selected from the group consisting of triazine derivatives corresponding to general formulae I and II is present in an amount of 0.05 to 2 wt %.

8. The detergent composition according to claim 1, wherein the one or more compounds selected from the group consisting of triazine derivatives corresponding to general formulae I and II is present in an amount of 0.2 wt % to 1 wt %.

9. A method comprising: providing a dyed textile substrate to be washed; and washing the dyed textile substrate in an aqueous solution comprising a color transfer inhibitor and a polymer of vinylpyrrolidone, vinylimidazole, vinylpyridine-N-oxide or a copolymer thereof, the color transfer inhibitor comprising one or more compounds selected from the group consisting of triazine derivatives corresponding to general formulae I and II:

$$T(NH—Ar(CO_2M)_a)_bHal_c \quad (I)$$

$$X—NH—CH_2CH_2—(NY—CH_2CH_2—)_nNH—X \quad (II)$$

wherein T represents a 1,3,5-triazinyl group; Ar represents a phenyl group; each M independently represents a substituent selected from the group consisting of H, Na, Li, and K; each Hal independently represents a halogen selected from the group consisting of Cl, Br, and I; each a independently represents 1, 2 or 3; b and c each represent 1 or 2 wherein b+c=3; each X represents a $T(NH—Ar(CO_2M)_a)_bHal_{c-1}$ group; each Y independently represents H or X; and n represents a number of 0 to 50.

10. The method according to claim 9, wherein the aqueous solution further comprises a surfactant.

11. The method according to claim 9, further comprising providing an undyed textile substrate, wherein the dyed textile substrate and the undyed textile substrate are washed together in the aqueous solution.

12. The method according to claim 10, further comprising providing an undyed textile substrate, wherein the dyed textile substrate and the undyed textile substrate are washed together in the aqueous solution.

13. A method comprising: providing a dyed textile substrate to be washed; and washing the dyed textile substrate in an aqueous solution comprising a detergent composition, the detergent composition comprising a surfactant, a polymer of vinylpyrrolidone, vinylimidazole, vinylpyridine-N-oxide or a copolymer thereof, and a color transfer inhibitor comprising one or more compounds selected from the group consisting of triazine derivatives corresponding to general formulae I and II:

$$T(NH—Ar(CO_2M)_a)_bHal_c \quad (I)$$

$$X—NH—CH_2CH_2—(NY—CH_2CH_2—)_nNH—X \quad (II)$$

wherein T represents a 1,3,5-triazinyl group; Ar represents a phenyl group; each M independently represents a substituent selected from the group consisting of H, Na, Li, and K; each Hal independently represents a halogen selected from the group consisting of Cl, Br, and I; each a independently represents 1, 2 or 3; b and c each represent 1 or 2 wherein b+c=3; each X represents a $T(NH—Ar(CO_2M)_a)_bHal_{c-1}$ group; each Y independently represents H or X; and n represents a number of 0 to 50.

14. The method according to claim 13, further comprising providing an undyed textile substrate, wherein the dyed textile substrate and the undyed textile substrate are washed together in the aqueous solution.

* * * * *